US006096141A

United States Patent [19]

King et al.

[11] Patent Number: 6,096,141

[45] Date of Patent: Aug. 1, 2000

[54] NICKEL-BASED SUPERALLOYS EXHIBITING MINIMAL GRAIN DEFECTS

[75] Inventors: Warren Tan King, Mauldin, S.C.; Tresa M. Pollock, Pittsburgh, Pa.; Christine Louise Zemsky, Glenmont, N.Y.; Wendy Howard Murphy, Cincinnati, Ohio

[73] Assignee: General Electric Co., Schenectady, N.Y.

[21] Appl. No.: 09/128,294

[22] Filed: Aug. 3, 1998

[51] Int. Cl.[7] ..... C22C 19/03

[52] U.S. Cl. ..... 148/429; 148/428; 420/445; 420/460

[58] Field of Search ..... 148/428, 429; 420/445, 460

[56] References Cited

U.S. PATENT DOCUMENTS

| | | | |
|---|---|---|---|
| 3,260,505 | 7/1966 | Ver Snyder . | |
| 3,494,709 | 2/1970 | Piearcey . | |
| 4,292,076 | 9/1981 | Gigliotti et al. . | |
| 4,677,035 | 6/1987 | Fiedler et al. | 428/680 |
| 5,035,958 | 7/1991 | Jackson et al. | 428/553 |
| 5,077,004 | 12/1991 | Schweizer et al. | 420/448 |
| 5,173,255 | 12/1992 | Ross et al. | 420/455 |
| 5,270,123 | 12/1993 | Walston et al. | 428/652 |
| 5,366,695 | 11/1994 | Erickson | 420/448 |
| 5,455,120 | 10/1995 | Walston et al. | 428/652 |
| 5,584,947 | 12/1996 | Raymond et al. | 148/556 |

*Primary Examiner*—John Sheehan
*Attorney, Agent, or Firm*—Nixon & Vanderhye

[57] ABSTRACT

Carbide-forming elements are added to nickel-based superalloys so as to minimize grain defects, such as freckle and stray grain defects. More specifically, carbide-forming elements that form from the liquid in the mushy zone of the solidification front of single crystal (SC) and directionally solidified (DS) nickel-based superalloys are added so as to reduce the formation of freckle and stray grain defects in such alloys. A preferred nickel-based superalloy includes, by weight, between about 6.00%–9.25% tantalum, 4.75%–6.50% tungsten, at least about 2.75% rhenium, between about 5.00% to about 7.00% aluminum, at least about 0.10% hafnium and carbon in an amount sufficient (typically between about 0.10–0.15% by weight) to form carbides with other constituents to reduce significantly freckle formation in the mushy zone of the superalloy during casting.

6 Claims, No Drawings

NICKEL-BASED SUPERALLOYS EXHIBITING MINIMAL GRAIN DEFECTS

FIELD OF THE INVENTION

The present invention relates generally to the field of nickel-based superalloys. In preferred embodiments, the present invention is related to single crystal (SC) and directionally solidified (DS) nickel-based superalloys which exhibit minimal grain defects when cast.

BACKGROUND AND SUMMARY OF THE INVENTION

Recent uses of single crystal (SC) nickel-based superalloys engineered for aircraft engines or large power generation turbine components have shown that such alloys are prone to defects, such as freckles and stray grains. In the past, these defects have not been a large concern because of the relatively small dimensions of the directionally solidified components in aircraft engines or the relatively low operating stress and temperatures in power generation turbines. However, more recently it has been desired to increase the operating regimes of power generation turbine components to higher temperatures using thinner walls in an effort to improve turbine performance. Such operating regimes have resulted in freckle and stray grain defects being life-limiting in such power generation turbine components.

Broadly, the present invention is embodied in the addition of carbide-forming elements to nickel-based superalloys so as to minimize grain defects, such as freckle and stray grain defects. More specifically, the present invention involves the addition of carbide-forming elements that form from the liquid in the mushy zone of the solidification front of single crystal (SC) and directionally solidified (DS) nickel-based superalloys so as to reduce the formation of freckle and stray grain defects in such alloys.

In a particularly preferred embodiment of the present invention, a nickel-based superalloy is provided which includes, by weight, between about 4.00% to less than 9.25% tantalum, between about 4.75% to about 6.50% tungsten, at least about 2.75% rhenium, between about 5.00% to 7.00% aluminum, at least about 0.10% hafnium and carbon in an amount sufficient to form carbides with other constituents to reduce significantly freckle formation in the mushy zone of the superalloy during casting.

The alloys of the present invention are especially useful to form cast turbine blades, particularly blades for power generation turbines. The castings can be used "as is", or may be subjected to further processing, such as high temperature solution and aging treatments, coating treatments and the like.

These and other aspects and advantages of the present invention will become more clear after careful consideration is given to the following detailed description of the preferred exemplary embodiments thereof.

DETAILED DESCRIPTION OF THE INVENTION

One particularly preferred superalloy of this invention includes, by weight, between about 6.00% to less than 9.25% tantalum, between about 4.75% to about 6.50% tungsten, at least about 2.75% rhenium, between about 5.00% to about 7.00% aluminum, at least about 0.10% hafnium, carbon, and the balance being essentially nickel.

The superalloy compositions of this invention necessarily include carbon to an extent that it forms carbides with other constituents in the alloy and to thereby reduce significantly freckle formation in the mushy zone during SC or DS casting. Specifically, carbon is present together with the other constituents, in an amount of at least about 0.10% and most preferably between about 0.10%–0.15%. The relatively high levels of carbon present in the alloys of the present invention is in apparent contrast to the art recognition that carbon content should be maintained at relatively low levels for single crystal and/or directional solidification techniques.

Tantalum will be present in the superalloys of the present invention in an amount between about 6.00% to less than 9.25% by weight. In addition, the superalloys of this invention will include at least about 0.10%, and more preferably between about 0.12 to about 0.30 (and advantageously between about 0.15–0.25%) hafnium by weight. Tantalum and hafnium are strong carbide formers. When alloyed with carbon at the levels required by the present invention, it has been found that the interaction effects reduce the tendency of nickel-based superalloys to freckle.

Rhenium will be present in the superalloys of the present invention in an amount of at least about 2.75% by weight, and typically between about 2.75–6.40%. Rhenium is most preferably employed in amounts sufficient to offset the lower amount of tungsten which is present. Specifically, in this regard, tungsten is present in an amount between 4.74% to about 6.50%, and typically between about 5.00% to about 5.75% by weight.

Aluminum will be present in amounts between about 5.00% to about 7.00% by weight, and more preferably between about 6.00% to 6.40% by weight. The combined amounts of aluminum and tantalum, however, should be at least about 12.45% by weight.

Other constituents may also be employed in the superalloys of this invention. Thus, for example, the superalloys of this invention may include at least one of chromium, cobalt, molybdenum, boron, yttrium, ruthenium and niobium. If employed, these optional constituents will be present in the following weight percentage ranges:

| | |
|---|---|
| chromium | 4.00–7.25 |
| cobalt | 7.00–15.00 |
| molybdenum | 0–2.00 |
| boron | 0.003–0.010 |
| yttrium | 0–0.03 |
| ruthenium | 0–6.00 |
| niobium | 0–1.00 |

One particularly preferred nickel-based superalloy has the following constituents present in the noted weight percent ranges:

| | |
|---|---|
| aluminum | 6.00–6.40 |
| tantalum | 6.30–6.70 |
| tungsten | 4.75–5.25 |
| rhenium | 2.75–3.25 |
| hafnium | 0.20–0.30 |
| carbon | 0.10–0.15 |
| chromium | 6.75–7.25 |
| cobalt | 7.00–8.00 |
| molybdenum | 1.30–1.70 |
| boron | 0.003–0.005 |
| nickel (essentially) | balance |

Another preferred nickel-based superalloy has the following constituents present in the noted weight percent ranges:

| | |
|---|---|
| aluminum | 5.50–6.00 |
| tantalum | 7.00–7.40 |
| tungsten | 5.75–6.25 |
| rhenium | 5.20–5.60 |
| hafnium | 0.12–0.18 |
| carbon | 0.10–0.15 |
| chromium | 4.00–4.50 |
| cobalt | 12.25–12.75 |
| molybdenum | up to 1.50 |
| boron | .003–0.010 |
| ruthenium | up to 6.00 |
| niobium | up to 1.00 |
| nickel (essentially) | balance |

The preferred superalloys with the high carbon content in accordance with the present invention may, for example, be those described more completely in U.S. Pat. Nos. 5,445,120 and 5,270,123 the entire content of each being expressly incorporated hereinto by reference.

By "essentially nickel" means that the superalloys of this invention may contain trace (trivial) amounts of other constituents which do not materially affect their basic and novel characteristics. Such other trace constituents may include, for example, sulfur, phosphorus, copper and like elements commonly encountered in trace amounts in the alloying constituents used.

The superalloys of the present invention are especially well suited for the production of components using single crystal casting techniques as described more fully in U.S. Pat. No. 3,494,709 (the entire content of which is expressly incorporated hereinto by reference) and by directional solidification techniques as described more fully in U.S. Pat. No. 3,260,505 (the entire content of which is expressly incorporated hereinto by reference).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A single crystal or directionally solidified nickel-based alloy consisting essentially of, based on weight, the following constituents:

6.00%–6.40% aluminum;
6.30%–6.70% tantalum;
4.75%–5.25% tungsten;
2.75%–3.25% rhenium;
0.15%–0.25% hafnium;
0.10%–0.15% carbon; and
the balance essentially nickel.

2. The alloy of claim 1, which further consists essentially of, by weight, the following constituents:

6.75%–7.25% chromium;
7.00%–8.00% cobalt;
1.30%–1.70% molybdenum; and
0.003%–0.005% boron.

3. The alloy of claim 1, wherein the combined amount of aluminum and tantalum is at least about 12.45%.

4. The alloy of claim 1, wherein hafnium is present in an amount of about 0.25%.

5. A single crystal or directionally solidified nickel-based alloy consisting essentially of, based on weight, the following constituents:

5.50%–6.00% aluminum;
7.00%–7.40% tantalum;
5.75%–6.25% tungsten;
5.20%–5.60% rhenium;
0.12%–0.18 hafnium;
0.10%–0.15% carbon; and
the balance essentially nickel.

6. The alloy of claim 5, which further consists essentially of, by weight, the following constituents:

4.00%–4.50% chromium;
12.25%–12.75% cobalt;
up to about 1.50% molybdenum;
0.003 –0.010% boron;
up to about 6.00% ruthenium; and
up to 1.00% niobium.

* * * * *

UNITED STATES PATENT AND TRADEMARK OFFICE

CERTIFICATE OF CORRECTION

PATENT NO. : 6,096,141
DATED : August 1, 2000
INVENTOR(S) : Warren T. KING et al It is certified that error appears in the above-identified patent and that said letters patent is hereby corrected as shown below:

Insert the following before column 1, line 1:

Government Rights Statement

This Invention was made with Government support under Contract No. DE-FC21-95MC31176 awarded by the Department of Energy. The Government has certain rights in this invention.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*